US006212340B1

(12) United States Patent
Sugimoto et al.

(10) Patent No.: US 6,212,340 B1
(45) Date of Patent: Apr. 3, 2001

(54) IMAGE FORMING APPARATUS UTILIZING A TWO-COMPONENT DEVELOPING APPARATUS WITH AUTOMATIC TONER REPLENISHMENT AND DEVELOPER REPLACEMENT

(75) Inventors: Katsumi Sugimoto; Kenji Fuke; Keiko Tonai; Hiroaki Yoshida; Yoshihiro Tonomoto; Eiji Suzuki; Tomoaki Tanaka; Katsuya Shimatsu; Yasuhiro Wakabayashi, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/328,401

(22) Filed: Jun. 9, 1999

Related U.S. Application Data

(62) Division of application No. 08/712,458, filed on Sep. 11, 1996, now Pat. No. 5,933,690.

(30) Foreign Application Priority Data

Mar. 29, 1996 (JP) ..... 8-076456

(51) Int. Cl.[7] ..... G03G 15/08

(52) U.S. Cl. ..... 399/27; 399/263

(58) Field of Search ..... 399/27–29, 43, 399/98–99, 119, 120, 258, 262, 263; 222/DIG. 1

(56) References Cited

U.S. PATENT DOCUMENTS

| | | | |
|---|---|---|---|
| 4,226,525 | 10/1980 | Sakamoto et al. | 399/29 |
| 5,235,391 | 8/1993 | Aimoto | 399/325 |
| 5,424,809 | 6/1995 | Sawayama et al. | 399/56 |
| 5,499,090 | 3/1996 | Ito et al. | 399/359 |
| 5,552,877 | 9/1996 | Ishikawa et al. | 399/227 |
| 5,592,270 * | 1/1997 | Takai et al. | 399/260 |
| 5,617,192 | 4/1997 | Tonomoto et al. | 399/263 |
| 5,918,094 * | 6/1999 | Masuda et al. | 399/258 |

FOREIGN PATENT DOCUMENTS

| | | |
|---|---|---|
| 2747014B2 | 12/1979 | (DE) . |
| 4113777A1 | 1/1992 | (DE) . |
| 19514664A1 | 10/1995 | (DE) . |
| 53-49439 | 5/1978 | (JP) . |
| 61-196268 | 8/1986 | (JP) . |
| 63-2091 | 1/1988 | (JP) . |
| 1-48019 | 2/1989 | (JP) . |
| 2-308184 | 12/1990 | (JP) . |
| 4-134391 | 5/1992 | (JP) . |
| 4-318886 | 11/1992 | (JP) . |
| 5-188777 | 7/1993 | (JP) . |

* cited by examiner

*Primary Examiner*—Quana M. Grainger
(74) *Attorney, Agent, or Firm*—Armstrong, Westerman, Hattori, McLeland & Naughton, LLP

(57) ABSTRACT

A developing apparatus develops a latent image formed on a latent image carrying body with a developer. The developing apparatus includes a developing unit having a means for supplying the developer to the latent image carrying body to develop the latent image on the latent image carrying body and a developer housing for accommodating the developer. A developer storage box stores the developer which is to be supplied to the developing unit. The developer storage box is detachably mounted on the developing unit and has a volume substantially the same as a volume of the developer which can be accommodated in the developer case of the developing unit. The developer in developer storage box is supplied to the developing unit.

2 Claims, 14 Drawing Sheets

IMAGE FORMING APPARATUS UTILIZING A TWO-COMPONENT DEVELOPING APPARATUS WITH AUTOMATIC TONER REPLENISHMENT AND DEVELOPER REPLACEMENT

This application is a division of prior application Ser. No. 08/712,458, filed Sep. 11, 1996, now U.S. Pat. No. 5,933, 690.

BACKGROUND OF THE INVENTION

1. Title of the Invention

The present invention relates to a developing unit for conducting development on a latent image carrier on which an image is formed, and also relates to an image forming apparatus, having the developing unit, to form an image and to transfer the formed image onto a recording medium.

2. Description of the Related Art

In a conventional image forming apparatus, a latent image is formed on a latent image carrier, and development is conducted on the latent image carrier by a developing unit, and then the developed image is transferred onto a sheet of paper which is a recording medium. In the above developing process, toner is used.

There is provided a developing method in which development is conducted as follows. In the developing process in which a latent image formed on the latent image carrier is developed with toner, a carrier to convey toner is used so that the development can be effectively conducted.

According to the above developing method, the carrier is circulated in the developing unit to develop the latent image, so that toner can be fed to the latent image carrier.

However, in a printing apparatus in which toner is used for printing, toner is transferred onto a sheet of paper which is a recording medium. Therefore, the quantity of toner accommodated in the printing apparatus is reduced each time it is used. Accordingly, it is necessary to feed toner to the developing unit.

The carrier is deteriorated by the friction when it is circulated in the developing unit, and it becomes impossible for the carrier to convey toner. For this reason, it is necessary to replace the carrier after it has been used over a predetermined period of time.

In the above-type of image forming apparatus, a multicolor printer including a plurality of developing units and latent image carriers has come into wide use.

However, in the above image forming apparatus, a developer which contains toner and a carrier is manually replaced by an operator, so that it takes much time and labor. Moreover, in the apparatus of multicolor printing, it is necessary to replace developer for each color. Therefore, it takes more time to replace developer of each color.

Accordingly, it is preferable to save time and labor in the process of replacing developer. Further, it is preferable to extend the life of the developer.

SUMMARY OF THE INVENTION

An object of the present invention is to provide a developing apparatus and an image forming apparatus in which a developer can easily be supplied or changed.

Another object of the present invention is to provide a developing apparatus, and an image forming apparatus, in which the used developer can be easily disposed of.

According to the present invention, there is provided a developing apparatus for developing a latent image formed on a latent image carrying body with a developer, the developing apparatus comprising: a developing unit including means for supplying the developer to the latent image carrying body to develop the latent image on the latent image carrying body and means for accommodating the developer; a developer storage means for storing the developer which is to be supplied to the developing unit, the developer storage means being detachably mounted on the developing unit and having a volume substantially the same as a volume of the developer which can be accommodated in the developing unit; and means for supplying the developer in the developer storage means to the developing unit.

According to another aspect of the present invention, there is provided a developing apparatus for developing a latent image formed on a latent image carrying body with a developer, the developing apparatus comprising: a developing unit including means for supplying the developer to the latent image carrying body to develop the latent image on the latent image carrying body and means for accommodating the developer; a developer storage means for storing the developer which is to be supplied to the developing unit, the developer storage means being detachably mounted on the developing unit and having a volume less than the volume of the developer which can be accommodated in the developing unit; and means for supplying the developer in the developer storage means to the developing unit.

According to still another aspect of the present invention, there is provided a developing apparatus for developing a latent image formed on a latent image carrying body with a developer, the developing apparatus comprising: a developing unit including means for supplying the developer to the latent image carrying body to develop the latent image on the latent image carrying body and means for accommodating the developer; a developer storage means for storing the developer which is to be supplied to the developing unit, the developer storage means being detachably mounted on the developing unit and having a volume which is an integral multiple of the volume of the developer which can be accommodated in the developing unit; and means for supplying the developer in the developer storage means to the developing unit.

According to a further aspect of the present invention, there is provided a developing apparatus for developing a latent image formed on a latent image carrying body with a developer, the developing apparatus comprising: a developing unit including means for supplying the developer to the latent image carrying body to develop the latent image on the latent image carrying body and means for accommodating the developer; a developer storage means for storing a fresh developer which is to be supplied to the developing unit; and developer changing means for replacing the developer accommodated in the developing unit with the fresh developer stored in the developer storage means in accordance with an instruction that the replacement of the developer is now required.

The developer changing means comprises a developer discharging means for discharging the developer from the developing unit and a fresh developer supplying means for supplying the fresh developer into the developing unit.

According to a further aspect of the present invention, there is provided a two-component developing apparatus for developing an electrostatic latent image formed on a latent image carrying body with a two-component developer, the developing apparatus comprising: a developing unit including means for supplying the developer to the latent image carrying body to develop the latent image on the latent image carrying body and means for accommodating the developer; a developer storage means for storing a fresh developer which is to be supplied to the developing unit; a toner storage means for storing a toner which is to be supplied to the developing unit; means for supplying the toner in the toner storage means to the developing unit in accordance with a first instruction that a supplement to the toner is required; and developer changing means for replacing the developer accommodated in the developing unit by the fresh developer stored in the developer storage means in accordance with a second instruction that a replacement of the developer is now required.

According to a still further aspect of the present invention, there is provided an image forming apparatus comprising: a plurality of latent image carrying bodies for carrying latent images; a plurality of developing units each including means for supplying a developer to the respective latent image carrying body to develop the latent image on the latent image carrying body and means for accommodating the developer; at least one developer storage means for storing a fresh developer which is to be supplied to at least one of the developing units; and developer changing means for replacing the developer accommodated in the developing unit by the fresh developer stored in the developer storage means in accordance with an instruction that a replacement of developer is now required.

The plurality of developing units develop with a plurality of different color developers and at least one developer storage means stores at least one color developer which is used most frequently among the plurality of different color developers.

The plurality of developing units develop with a plurality of different color developers including a black developer and the developer storage means stores the black developer which is to be supplied to the developing unit which develops with the black developer.

The plurality of developing units develop with a plurality of different color developers including a black developer and the developer storage means stores a black developer which is to be supplied to a black developing unit which develops with the black developer, the developer storage means has a volume which is an integral number of times as large as the volume of the black developer which can be accommodated in the black developing unit.

According to a still further aspect of the present invention, there is provided an image forming apparatus comprising: a plurality of developing units each having means for accommodating a developer; a plurality of feeding means for discharging used developers from the respective developing units; and a single collecting means for collecting the used developers discharged by the respective feeding means.

According to a still further aspect of the present invention, there is provided an image forming apparatus comprising: a plurality of process units each including a latent image carrying body on which a latent image is formed, which latent image is to be developed by a developer and transferred to a transferring medium; a plurality of feeding means for discharging used developers from the respective process units; and a single collecting means for collecting the used developers discharged by the respective feeding means.

Each of the process units comprises a developing unit which develops the latent image on the latent image carrying body and a means for cleaning the latent image carrying body.

According to a still further aspect of the present invention, there is provided an image forming apparatus comprising: a plurality of latent image carrying bodies on which latent images are formed; a plurality of developing units each developing the latent image on the respective latent image carrying body and having a developer outlet port for discharging a developer which is to be disposed of; a plurality of cleaning means each cleaning the respective latent image carrying body and having a cleaner outlet port for discharging a developer recovered from the latent image carrying body as a result of cleaning, the cleaner outlet port is aligned with the developer outlet port of the adjacent developing unit; a plurality of feeding means for discharging the developer discharged from the developer outlet ports and the cleaner outlet port; and a single collecting means for collecting the developers discharged by the respective feeding means.

Each of the feeding means comprises a falling section for passing down the discharged developer and a power feeding means for feeding the developer to the collecting means.

The falling section is commonly provided for the adjacent developing unit and the cleaning means.

According to a still further aspect of the present invention, there is provided an image forming apparatus comprising: latent image carrying bodies on which latent images are formed; a developing unit which develops the latent image on the respective latent image carrying body and having a developer outlet port for discharging a developer which is to be disposed; a developer storage means for storing the developer which is to be supplied to the developing unit; a feeding means for discharging the developer discharged from the developing unit; and a collecting means for collecting the developers discharged by the feeding means.

According to a still further aspect of the present invention, there is provided an image forming apparatus comprising: a plurality of latent image carrying bodies on which latent images are formed; a plurality of developing units each developing the latent image on the respective latent image carrying body and having a developer outlet port for discharging a developer which is to be disposed; a developer storage means for storing the developer which is to be supplied to the developing units; a plurality of feeding means for discharging the developer discharged from the respective developing units; and a collecting means for collecting the developer discharged by the plurality of feeding means.

BRIEF DESCRIPTION OF THE DRAWINGS

FIG. 3(*b*) is a front view showing a developer feed unit.

FIG. 14(*b*) is a view showing the detail of a partition plate.

DESCRIPTION OF THE PREFERRED EMBODIMENTS

A multicolor electrostatic recording apparatus of an image forming apparatus according to the present invention will now be described in detail with reference to FIGS. 1 and 2.

Figure 1:
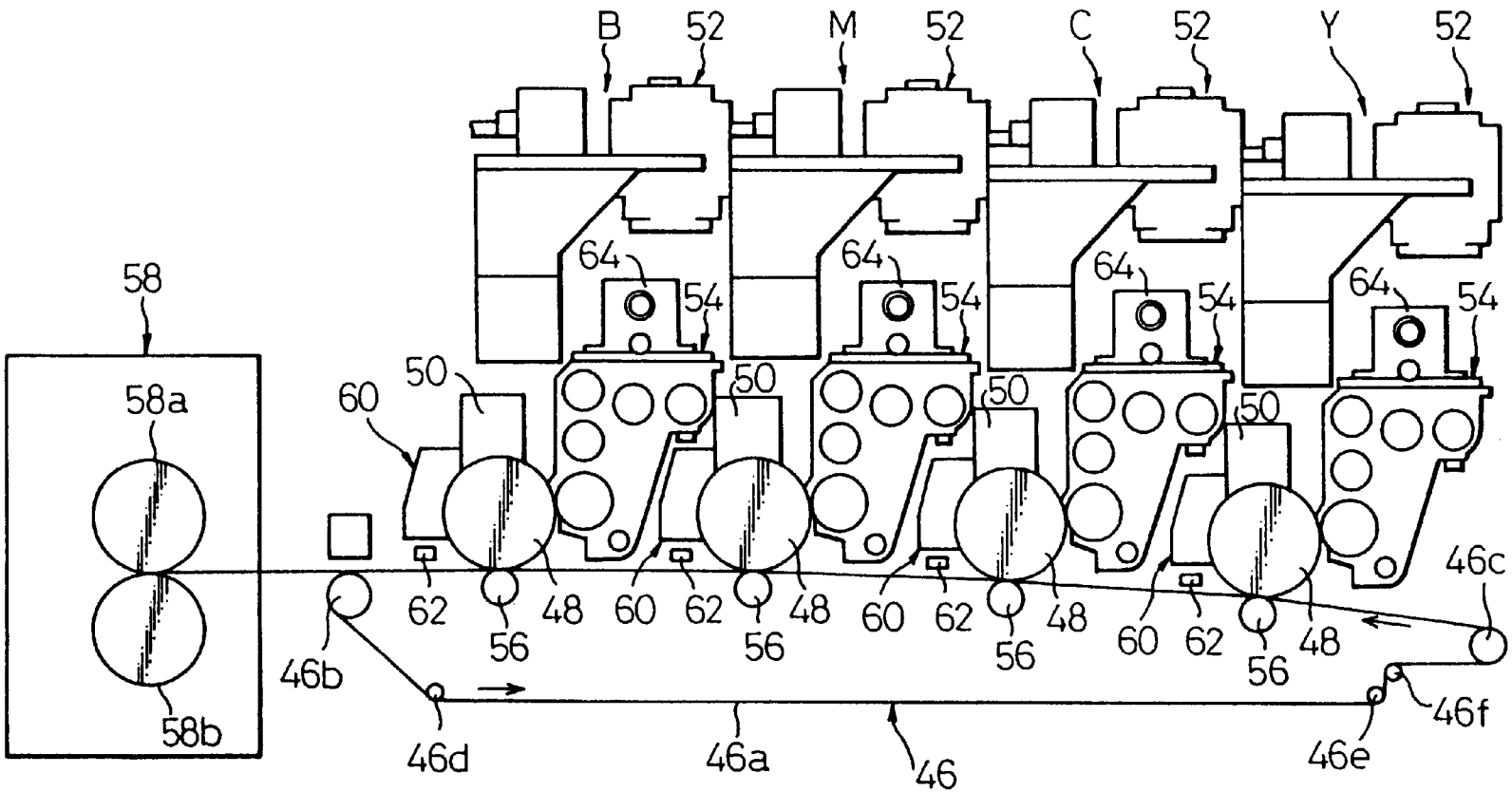
FIG. 1 is a schematic illustration of a multicolor electrostatic recording apparatus.

An embodiment of the multicolor electrostatic recording apparatus of the present invention is shown in FIG. 1. This multicolor electrostatic recording apparatus includes an endless belt conveyance means 46 for conveying a recording medium, for example, a recording sheet. The endless belt conveyance means 46 is composed of an endless belt 46*a* made of flexible dielectric material, for example, an appropriate synthetic resin. This endless belt 46*a* is provided around 4 rollers 46*b*, 46*c*, 46*d*, 46*e*. The roller 46*b* is a drive roller. This drive roller 46*b* drives the endless belt 46*a* in the direction of the arrow by an appropriate drive mechanism not shown in the drawing. The roller 46*c* functions as an idle roller. This roller 46*c* also functions as a charging roller to give an electric charge onto the endless belt 46*c*. Both rollers 46*d* and 46*e* function as guide rollers. The guide roller 46*d* is disposed close to the drive roller 46*b*, and the guide roller 46*e* is disposed close to the idle roller 46*c*. There is provided a tension roller 46*f* between the idle roller 46*c* and the guide roller 46*e*. The endless belt 46*a* is given an appropriate amount of tension by this tension roller 46*f*. There is formed a recording sheet movement path in an upside sheet traveling section of the endless belt 46*a*, that is, a sheet traveling section formed between the drive roller 46*b* and the idle roller 46*c*. A recording sheet is introduced into the sheet traveling section from the side of the idle roller 46*a* and ejected from the side of the drive roller 46*b*. When the recording sheet is introduced to the sheet traveling section from the side of the idle roller 46*a*, the recording sheet is attracted onto the endless belt 46*a* by the action of the electric charge on the endless belt 46*a*. There is provided an AC discharging unit 46*g* on the side of the drive roller 46*b*. The endless belt 46*a* is electrically discharged by the AC discharging unit 46*g*. Due to the foregoing, when the recording sheet is ejected from the side of the drive roller 46*b*, it can be easily separated from the endless belt 46*a*.

The multicolor electrostatic recording apparatus comprises 4 sets of electrostatic recording units Y, C, M and B. These electrostatic recording units Y, C, M and B are arranged in series along the upside sheet traveling section of the endless belt 46*a* from the upstream side to the downstream side. The electrostatic recording units Y, C, M and B have the same structure, however, colors of the images formed by the electrostatic recording units Y, C, M and B are different. Each electrostatic recording unit is provided with a photoreceptor drum 48. In the process of the recording operation, the photoreceptor drum 48 is rotated in the arrowed direction in the drawing. Above the photoreceptor drum 48, there is provided a pre-charger 50 which is composed of a corona charging unit such as a scorotron charging unit or a corotron charging unit. A rotational surface of the photoreceptor drum 48 is uniformly charged by the pre-charger 50. An electrostatic latent image is written in the electrically-charged region on the photoreceptor drum 50 by an optical writing means such as a laser beam scanner 52. In this connection, the laser beam scanner 52 is the bulkiest among the components composing the electrostatic recording unit. Therefore, the laser beam scanner 52 is arranged at the uppermost position so that the installation space of the electrostatic recording unit can be reduced.

The electrostatic latent image written on the photoreceptor drum 48 is electrostatically developed by the developing unit 54 using toner of a predetermined color, so that an electrically-charged toner image can be formed. The developing unit 54 is arranged on the upstream side of the recording movement path with respect to the photoreceptor drum 48. The electrically-charged toner image is electrostatically transferred onto a recording medium such as a recording sheet by the conductive transfer roller 56 disposed at a lower position of the photoreceptor drum 40. As shown in FIG. 1, the conductive transfer roller 56 is opposed to the photoreceptor drum 48 via an upside sheet traveling section on the endless belt 46*a*. The conductive transfer roller 56 provides an electric charge, the polarity of which is opposite the polarity of the electrically-charged toner image, to the recording sheet conveyed by the endless belt 46*a*. Due to the foregoing, the electrically-charged toner image is electrostatically transferred from the photoreceptor drum 56 onto the recording sheet.

According to the above structure, the operation is carried out as follows. When the recording sheet is introduced by the idle roller 46*c* of the endless belt conveyance means 46 and successively passes through the electrostatic recording units Y, C, M and B, toner images of 4 colors are superimposed on the recording sheet so that a full color image can be formed. Then, the recording sheet is sent from the drive roller 46*b* of the endless belt conveyance means 46 to the thermal fixing unit 58. Then the full color image is thermally fixed onto the recording sheet by the thermal fixing unit 58. In this connection, the thermal fixing unit 58 is of the conventional type composed of a heat roller 58*a* and a backup roller 58*b*. On the other hand, in each electrostatic recording apparatus, residual toner, which is left on the surface of the photoreceptor drum 48 without being transferred onto the recording sheet, is deposited on the surface of the photoreceptor drum 48 after the completion of the transfer process. This residual toner is removed from the surface of the photoreceptor drum 48 by the cleaning unit 60. This cleaning unit 60 is arranged on the downstream side of the recording sheet movement path with respect to the photoreceptor drum 48. In this connection, in FIG. 1, reference numeral 62 represents a light emitting body for discharging, such as a light-emitting diode, by which the electric charge is removed from the surface of the photoreceptor drum 48 that has completed the transfer process, and reference numeral 64 represents a toner replenishing container for replenishing an appropriate quantity of toner component to the developer 54.

Electrostatic Recording Unit

Figure 2:
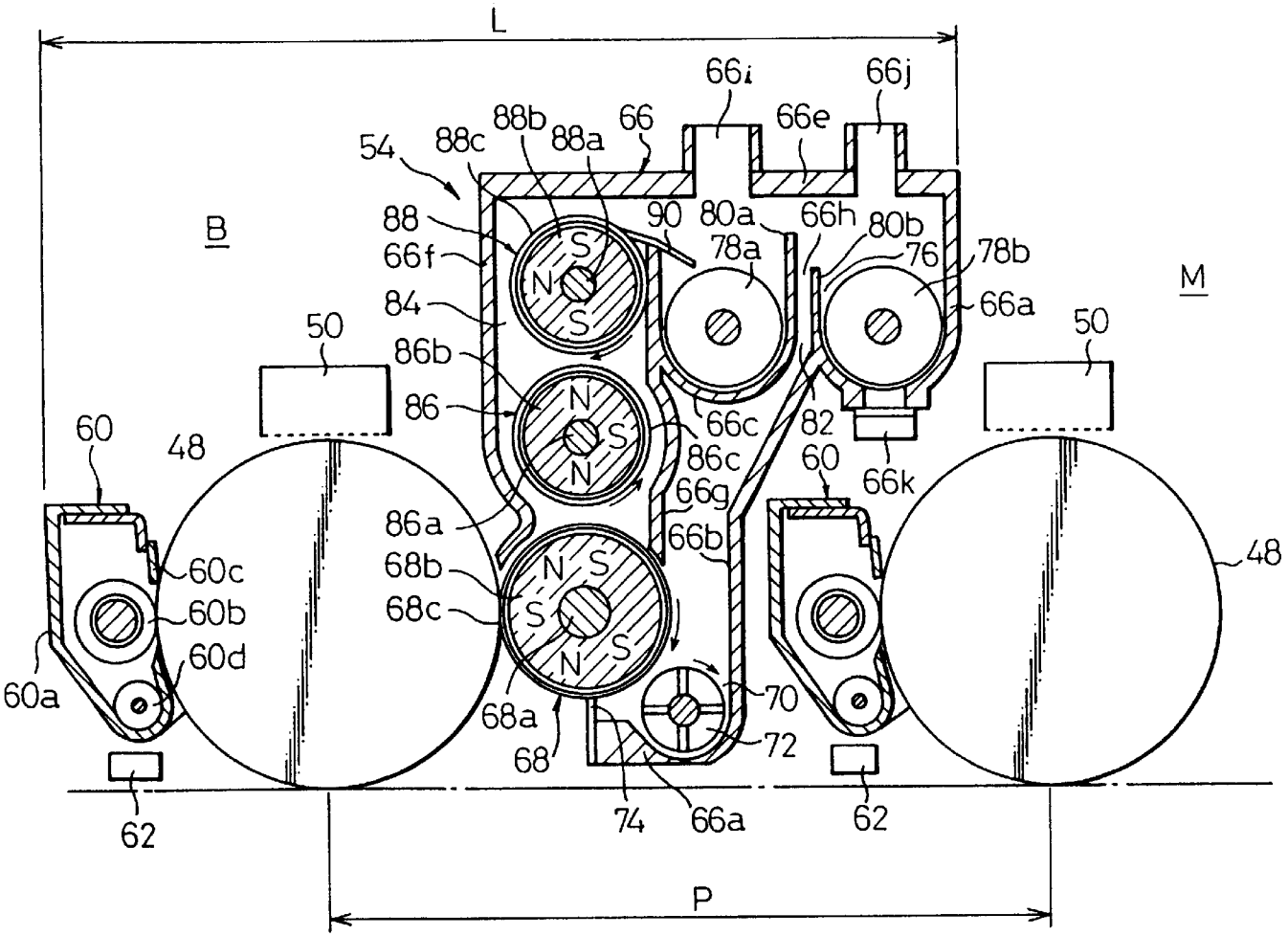
FIG. 2 is a view showing an electrostatic recording unit.

In FIG. 2, there is schematically shown a portion of the electrostatic recording unit B arranged above the endless conveyance belt 46. As shown in FIG. 2, the developing unit 54 includes a developer holding container 66 in which a two-component developer is accommodated. The developer holding container 66 includes: a first bottom wall portion 66*a*; a first rear wall portion 66*b* extending upward from the back of the first bottom wall portion 66*a*; a second bottom wall portion 66*c* extending horizontally at an upper end of the first rear wall portion 66*b*; a second rear wall portion 66*d* extending upward from the back of the second bottom wall portion 66*c*; a top wall portion 66*e* extending horizontally to the front from an upper end of the second rear wall portion 66*d*; and a front wall portion 66*f* extending downward from the front end of the top wall portion 66*e*. Both ends of these wall portions are respectively integrated with the side wall portions (not shown) into one body. There is provided an opening between the front end of the first bottom wall portion 66*a* of the developer holding container 66 and the lower end of the front wall portion 66*f*. In the opening, there is provided a magnetic roller, that is, a developing roller 68, in such a manner that a portion of the developing roller 68 is exposed outside. The developing roller 68 includes: a shaft 68*a* supported and fixed by both wall portions of the developer holding container 66; a core portion 68*b* made of magnetic material mounted on the shaft 68*a*; and a sleeve 68*c* made of non-magnetic material such as aluminum rotatably arranged around the core portion 68*b*. In the operation of the developing unit 54, the sleeve 68*c* is rotated in the direction of the arrow in the drawing. When the developing unit 54 shown in the drawing is installed in the electrostatic recording apparatus, an exposed surface of the developing roller 68, that is, the sleeve 68*c* is opposed to an electrostatic latent image carrier such as a photoreceptor drum.

By the first bottom wall portion 66*a* of the developer holding container 66, a developer storage portion 70 is formed, in which a paddle roller 72 is provided. This paddle roller 72 is rotatably supported by both side wall portions of the developer holding container 66. In the operation of the developing unit 54, the paddle roller 72 is driven in the direction of the arrow shown in the drawing. The paddle roller 72 supplies the developer accommodated in the developer storage portion 70 toward the developing roller 68. The developer is carried by the developing roller 68 and conveyed to an opposing region in which the developing roller 68 is opposed to an electrostatic latent image carrier such as a photoreceptor drum, that is, the developer is conveyed to a developing region. In order to regulate a quantity of developer to be conveyed to the developing region by the developing roller 68, a developer regulating blade 74 is mounted on a front edge of the first bottom wall portion 66*a*.

The second bottom wall portion 66*c* of the developer holding container 66 provides a developer agitating portion 76 located above the developer storage portion 70. In this developer agitating portion 76, there is provided a developer agitator 78. The developer agitating portion 76 partially protrudes to the rear side of the developer storage portion 70, and a space is formed under this protruding portion. In this embodiment, the developer agitator 78 is composed of a pair of conveyance screws 78*a*, 78*b* provided between both end walls of the developer holding container 66. This pair of conveyance screws 78*a*, 78*b* are disposed in parallel to each other. As can be seen in FIG. 2, on an upper face of the second bottom wall portion 66*c*, there are formed a pair of curved recess portions in which the pair of conveyance screws 78*a*, 78*b* are received. Shafts of the conveyance screws 78*a*, 78*b* are rotatably supported by both side walls of the developer holding container 46. In the operation of the developing unit 54, the shafts of the conveyance screws 78*a*, 78*b* are rotated in the arrowed directions respectively shown in the drawing, that is, the shafts of the conveyance screws 78*a*, 78*b* are rotated in directions opposite to each other. In this embodiment, the blades of both conveyance screws 78*a*, 78*b* are composed in the manner of a right-handed screw. Therefore, the conveyance screw 78*a* conveys the developer in a direction perpendicular to the surface of FIG. 2 to a side opposite to the viewer's side. The conveyance screw 78*b* conveys developer in a direction perpendicular to the surface of FIG. 2 to the viewer's side. Between the conveyance screws 78*a* and 78*b*, there are provided a pair of partition walls 80*a* and 80*b* which are perpendicular to the second bottom wall portion 66*c*. Lengths of the pair of partition walls 80*a* and 80*b* are shorter than the lengths of the conveyance screws 78*a* and 78*b*, and both ends of the pair of partition walls 80*a* and 80*b* are separate from the side wall portions by a predetermined distance. Accordingly, a developer circulation path is formed by the conveyance screws 78*a* and 78*b*. That is, the developer is circulated as follows. When the developer is conveyed by the conveyance screw 78*a* to its end, the developer passes through end portions of the pair of partition plates 80*a*, 80*b* and is moved to the conveyance screw 78*b* side. When the developer is conveyed by the conveyance screw 78*b* to its end, the developer passes through the opposite end portions of the pair of partition plates 80*a*, 80*b*. Therefore, the developer is moved again to the conveyance screw 78*a* side. In this way, the developer is circulated along the pair of conveyance screws 58*a* and 58*b*.

Between the pair of partition plates 80*a*, 80*b*, there is provided a communication path 82 to communicate the developer storage portion 70 with the developer agitating portion 76, and an upper opening of this communication path 82 forms a developer overflow port 66*h* for the developer accommodated in the developer agitating portion 76. As shown in FIG. 2, the partition plate 80*b* is lower than the partition plate 80*a*, so that an upper edge of the partition plate 80*b* works as a developer overflow edge. That is, a portion of the developer circulated by the conveyance screws 78*a*, 78*b* overflows the upper edge of the partition plate 80b and drops into the communication path 82. Due to the foregoing, the developer is supplied from the developer agitating portion 76 to the developer storage portion 70.

As shown in FIG. 2, a vertical partition wall portion 66*g* is integrally formed on the front wall portion of the second bottom wall portion 66*c* of the developer holding container 66. There is formed a developer elevating path 84 between the vertical partition wall portion 66*g* and the front wall portion 66*f*. This developer elevating path 82 is arranged immediately above the developing roller 68. In the developer elevating path 84, there are provided two magnetic rollers 86 and 88 which are aligned in the vertical direction with respect to the developing roller 68. The magnetic rollers 86 and 88 have the same structure as that of the developing roller 68 which is composed as a magnetic roller. Each magnetic roller 86, 88 includes: a shaft 86*a*, 88*a* supported and fixed by both wall portions of the developer holding container 66; a core portion 86*b*, 88*b* made of magnetic material mounted on the shaft; and a sleeve 86*c*, 88*c* made of non-magnetic material such as aluminum rotatably arranged around the core portion 68*b*. In the operation of the developing unit 54, the sleeves 86*c*, 88*c* are rotated in the directions of the arrow shown in the drawing. The core portion 68*b* of the developing roller 68, the core portion 86*b* of the magnetic roller 86, and the core portion 88*b* of the magnetic roller 88 are locally magnetized along the peripheries as shown in FIG. 2. When the core portions 68*b*, 86*b*, 88*b* are locally affected by the magnetic field, it is possible to accomplish the local magnetization as described above. Magnetic poles of the core portion 68*b* of the developing roller 68 are arranged so that the developer can be conveyed from the developer storage portion 70 to the developing region in accordance with the rotation of the sleeve 68*c*. In this way, the developer is conveyed to the lower side of the magnetic roller 86. Magnetic poles of the core portion 86*b* of the magnetic roller 86 are arranged so that the developer can be lifted from the upside of the developing roller 68 to the downside of the magnetic roller 88 in accordance with the rotation of the sleeve 86*c*. Magnetic poles of the core portion 88*b* of the magnetic roller 88 are arranged so that the developer can be lifted from the upside of the magnetic roller 86 to the upside of the magnetic roller 88 in accordance with the rotation of the sleeve 88*c*. Due to the foregoing structure, the developer conveyed to the developing region by the developing roller 68 is not returned to the developer storage portion 70 but raised to the upside of the uppermost magnetic roller 88.

A scraper member 90 is mounted on the upper end of the vertical partition wall portion 66*g*. A front end of this scraper member 90 contacts with the magnetic roller 88 at a position located slightly to the rear of the top of the magnetic roller 88. After the developer has been raised to the upside of the magnetic roller 88, it is supplied to the conveyance screw 78*a* of the developer agitating portion 76 by the action of the scraper member 90.

To sum up, the developer held in the developer holding container 66 is supplied from the developer agitating portion 76 to the developer storage portion 70 via the developer overflow outlet 66*h* and communication path 82; then the developer is conveyed from the developer storage portion 70 to the developing region by the developing roller 68; after the developer has passed through the developing region, it is successively raised by the magnetic rollers 86, 88; and finally, the developer is returned to the developer agitating portion 76 via the scraper member 90. In this way, when the developing unit 54 is operated, the developer is continuously circulated in the developer holding container 66. Due to the foregoing, it can be ensured that sufficiently agitated developer is always supplied, to the developer storage portion 70, (that is, in the supplied developer, the components of toner and magnetic carrier are triboelectrically charged and the toner component is uniformly distributed in the magnetic carrier component).

The structure of the developing unit 54 described above is characterized in that: the developer holding container 66 is divided into the developer storage portion 70 and the developer agitating portion 66; and the relatively bulky developer agitating portion 66 is arranged at an upper position of the developer storage portion 70. According to the structure of the developer holding container 66 described above, it is possible to greatly reduce the size of the developer storage portion 70. In this connection, as described above, since the laser beam scanner 52 is the most bulky component among the components which composes the electrostatic recording unit, it is arranged at the uppermost position of the electrostatic recording unit. However, in the uppermost portion of the electrostatic recording unit, there is a sufficiently large space to accommodate the developer agitating portion 76 of the developer holding container 66. For this reason, even if the developer agitating portion 76 is arranged in the upper portion of the developer storage portion 70, the size of the electrostatic recording unit itself is not increased.

The arrangement of the cleaning unit 60 will be described in detail as follows. The cleaning unit 60 includes: a toner recovery container 60*a* having an opening portion through which a portion of the photoreceptor drum 48 is received; a fur brush 60*b* arranged in the toner recovery container 60*a* in such a manner that the fur brush 60*b* is disposed close to the opening portion of the toner recovery container 60*a*; a toner scraping blade 60*c* arranged along an upper edge of the opening portion of the toner recovery container 60*a*; and a conveyance screw 60d arranged in a bottom portion of the toner recovery container 60*a*. In this case, the fur brush 60*b* brushes the residual toner off the surface of the photoreceptor drum 48, and the scraping blade 60*c* scrapes off the residual toner that cannot be removed by the fur brush 60*b*. Residual toner removed by the fur brush 60*b* and the scraping blade 60*c* is temporarily recovered into the toner recovery container 60*a*. The recovered toner is conveyed from the toner recovery container 60*a* to a predetermined place by the toner conveyance screw 60*d*.

In FIG. 2, there are also shown a photoreceptor drum 48, a pre-charger 50 and a cleaning unit 60 of the electrostatic recording unit M which is adjacent to the electrostatic recording unit B. In this case, attention should be given to the following specific arrangement. The cleaning unit 60 of the electrostatic recording unit M is adjacent to the developer storage portion 70 of the developer holding container 66 of the electrostatic recording unit B. Further, the cleaning unit 60 of the electrostatic recording unit M can be disposed below the developer agitating portion 76 of the electrostatic recording unit B. In other words, according to this embodiment, when the developer agitating portion 76 partially protrudes into the rear side of the developer storage portion 70 of the developer holding container 66 of the electrostatic recording unit B, a space is formed below the developer agitating portion 76, so that the cleaning unit 60 of the electrostatic recording unit M can be accommodated in the space. The aforementioned arrangement is not limited to the electrostatic recording units B and M, but the arrangement can be applied to any two sets of electrostatic recording units which are adjacent to each other. In this way, although the length of each electrostatic recording unit Y, C, M, B in the recording sheet movement direction is "L", the arrangement pitch "P" of the photoreceptor drum 48 can be reduced to a value smaller than the length "L", of each electrostatic recording unit (FIG. 2). Due to the foregoing, the arrangement length of the electrostatic recording unit can be greatly reduced as compared with the conventional electrostatic recording unit. Therefore, the overall structure of the multicolor recording apparatus can be downsized.

In the above embodiment, the two magnetic rollers 68, 88 are used for the developer lifting means for lifting the developer from the developing roller 68 so as to return it to the developer agitating section 76. However, it should be understood that a single magnetic roller may be used for the developer lifting means, if necessary, or alternatively not less than 3 magnetic rollers may be used.

Developer Feed Unit

Figure 3A:
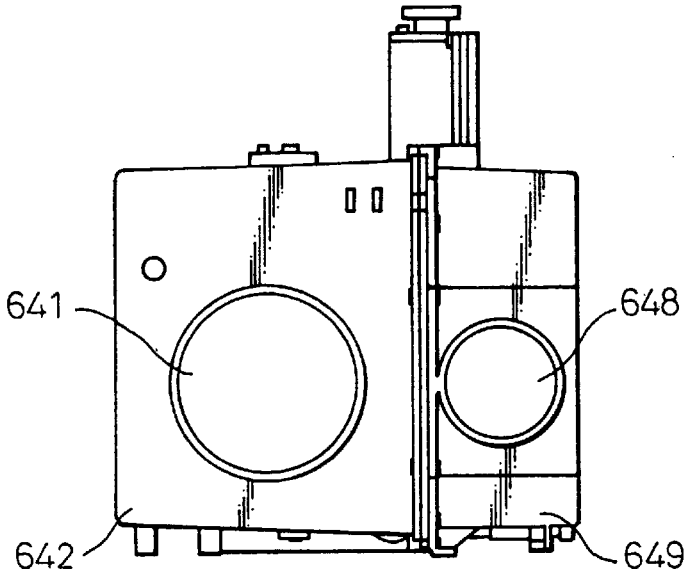
FIG. 3(*a*) is a plan view showing a developer feed unit.
Figure 3B:
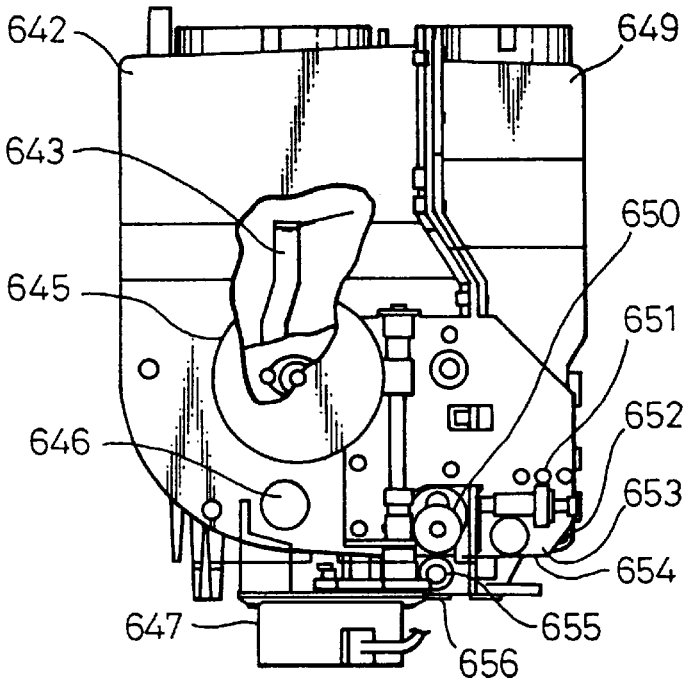
Figure 4:
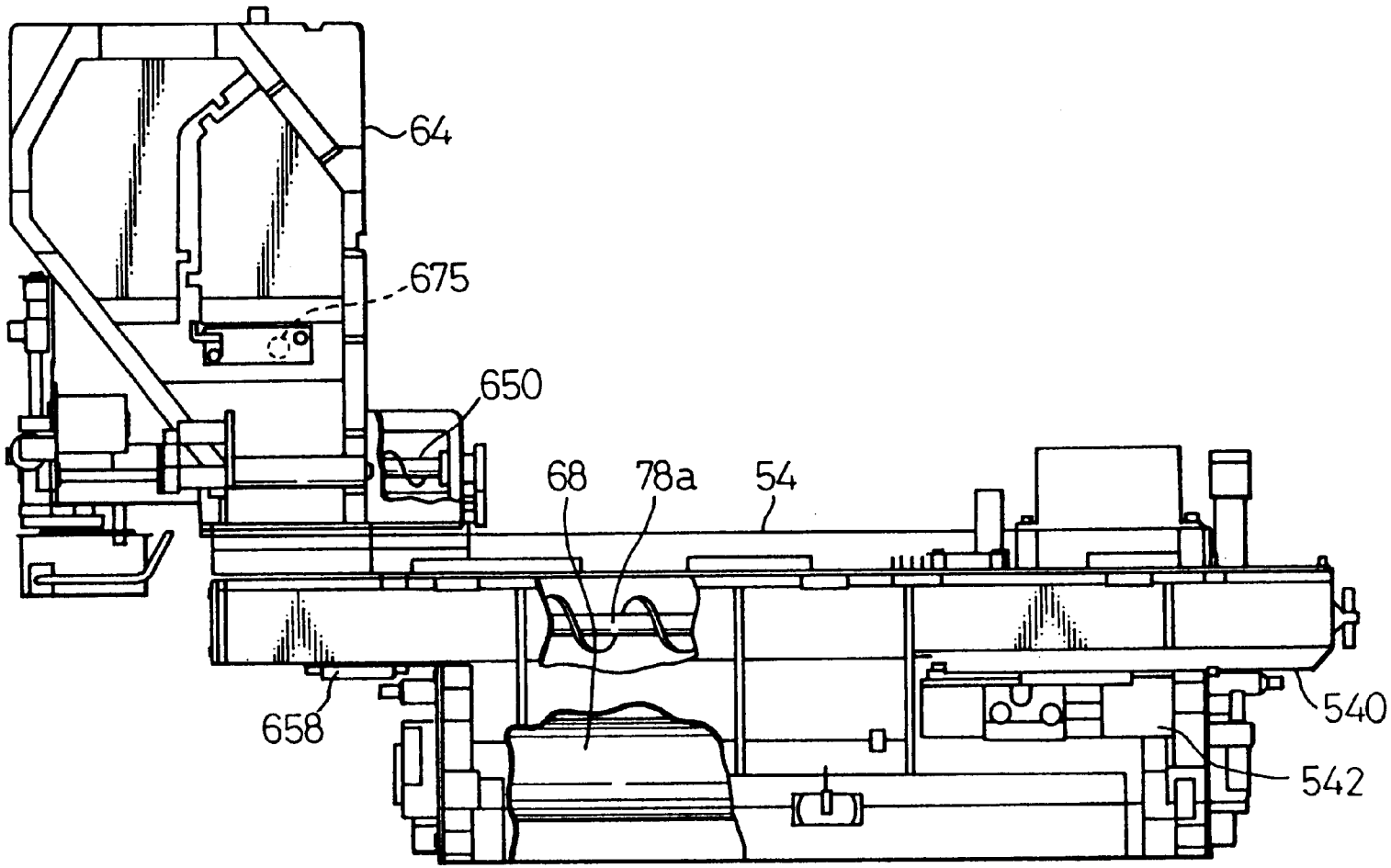
FIG. 4 is a view showing a developer feed unit and a developing unit.

FIGS. 3(*a*) and 3(*b*) are views showing a developer feed unit. FIG. 3(*a*) is a top view of the developer feed unit, and FIG. 3(*b*) is a front view of the developer feed unit. FIG. 4 is a view showing a developing unit 54 and a developer feed unit 64.

This developer feed unit 64 feeds developer to the developing unit 54.

This developer feed unit 64 includes a toner box 642 for accommodating toner to be fed to the developing unit 54, and a developer box 649 to feed developer to the developing unit 54.

Toner is accommodated in the toner box 642. When the concentration of toner in the developing unit 54 is lowered, toner is fed from the toner box 642 to the developing unit 54. in the developer box 649, the mixture of toner and carrier, which is a developer, is accommodated. When it becomes necessary to replace the developer in the developing unit 54, the developer is fed from the developer box 649 to the developing unit 54.

There is provided a conveyance screw 78*a* for conveying the developer fed to the developing unit 54. This conveyance screw 78*a* is longer than the developing roller 68. The developer feed unit 64 is attached to a portion of the conveyance screw 78*a*, wherein this portion is protruded with respect to the developing roller 68 since the conveyance screw 78*a* is longer than the developing roller 68.

Developer that has been fed from the developer feed unit 64 is conveyed by the conveyance screw 78*a*. Due to the foregoing conveyance motion, a substantially uniform quantity of developer is fed onto the developing roller 68. Accordingly, it is possible to form bristles of developer of uniform height on the developing roller 68.

In the developer box 649 of the developer feed unit 64, there is provided a remaining developer detection sensor 657. This remaining developer detection sensor 657 detects a quantity of remaining developer in the developer box 649. When a quantity of developer accommodated in the developer box 649 is substantially the same as a quantity of developer to be accommodated in the developing unit 54, or alternatively when a quantity of developer accommodated in the developer box 649 is a little smaller than a quantity of developer to be accommodated in the developing unit 54, in other words, when a quantity of developer accommodated in the developing box 649 can be fed into the developing unit by one feeding operation, this remaining developer detection sensor 657 is not required. However, when a quantity of developer accommodated in the developer box 649 is several times as large as the quantity of developer to be accommodated in the developing unit 54, for example, when a quantity of developer accommodated in the developer box 649 is twice as large as the quantity of developer to be accommodated in the developing unit 54, it is necessary to monitor the quantity of developer remaining in the developer box 649. In this case, the remaining developer detection sensor 657 must be provided. In a color printer in which four developing units 54 are arranged as illustrated in FIG. 1, printing is commonly conducted in such a manner that four color developers of yellow, magenta, cyan and black are accommodated and the respective latent images are developed by the developers of 4 colors, and that the thus developed color images are transferred onto a sheet of paper. In these four colors, black is most frequently used. Accordingly, the capacity of the developer box 649 in which black developer is accommodated is made to be larger than the capacity of developer boxes 649 of other colors. For example, the capacity of the developer box 649 in which each of the yellow, magenta and cyan developers is accommodated is made to be substantially the same as the capacity of the developing unit 54, so that the developer in the developing unit 54 can be once replaced with the developer accommodated in each of the yellow, magenta and cyan developer boxes 649, and the capacity of the black developer box is made to be twice as large as the capacity of the developing unit 54, so that the black developer in the black developing unit 54 can be replaced twice with the developer accommodated in the developer box. Due to the foregoing, the replacement time of the developer of each color can be made substantially the same. When the capacity of the developer box 649 is too large, the dimensions of the apparatus are excessively increased, and moreover the developer accommodated in the developer box absorbs the moisture in the atmosphere and is solidified. In order to avoid the above disadvantages, it is appropriate to determine the capacity of the black developer box 649 to be twice as large as the capacity of the developing unit 54 and also to determine the capacity of other color developer boxes 649 to be the same as the capacity of the developing unit 54.

Explanation of Replacement of Developer Conducted Manually by an Operator

Figure 8:
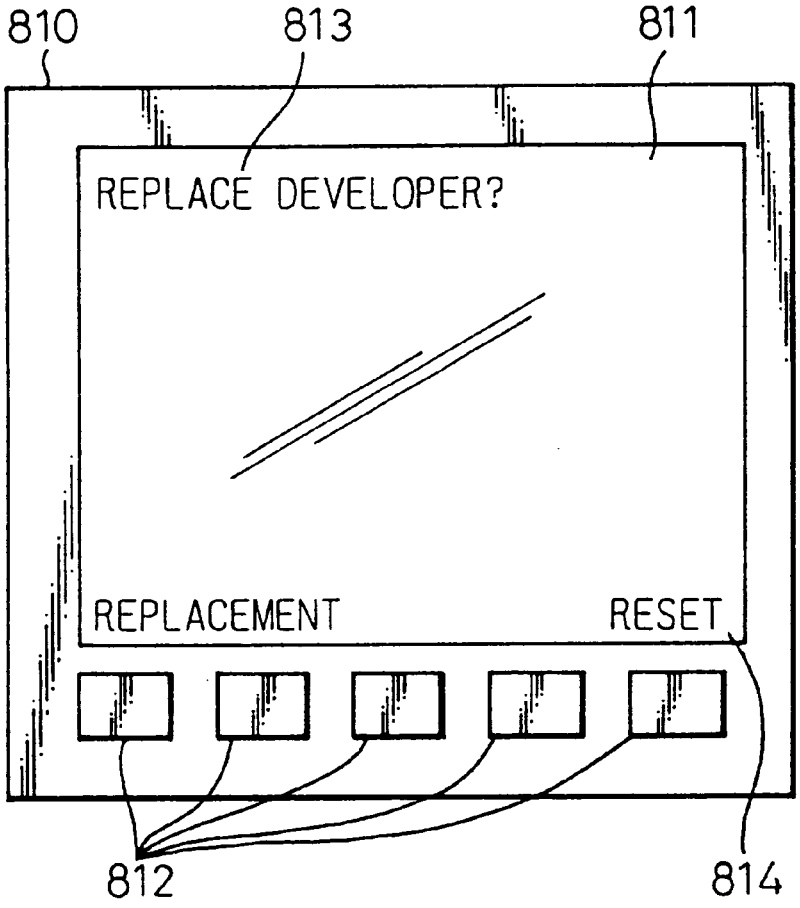
FIG. 8 is a view showing an operation panel.

In accordance with the flow chart of a sequence of replacement of developer shown in FIGS. 5 and 6, the feed motion of developer will be explained as follows. FIG. 8 is a view showing an operation panel. The operation panel 810 includes: a display section 811 for displaying a message 813 and a key definition 814; and an indication button 812, which is a push button, for indicating the key definition allotted to the key definition 814. This operation panel 810 is attached on a casing of the multicolor electrostatic recording apparatus at a position where an operator can operate it.

In the multicolor electrostatic recording apparatus, the time to replace the developer in the developing unit 54 is detected when the number of revolutions of the developing roller 68 is counted.

When the number of revolution of the developing roller 68 reaches a predetermined value, which corresponds to 150,000 sheets of printing paper, the life of the developer is nearly over, and it is necessary to prepare to replace the developer. In order to notify the operator of the necessity of replacement of the developer, the message is displayed on the message display section 811 (step 51). Magnet rollers 86, 88 and a developer agitating section 76 are driven in conjunction with the rotation of the developing roller 68. Since the developer is always circulated in a developer holding container 66, stress is given to the developer, so that the developer is deteriorated. As a result, it becomes impossible to electrically charge the developer, and development can not be attained. In order to prevent the occurrence of the above problems, the life of the developer is detected in such a manner that the number of revolution of the developing roller 68 is counted after the replacement of the developer, and that the deterioration of the developer is estimated by the counted value. This method of detecting the life of the developer can be attained by making experiments. Since the magnet roller 86 and other members to convey the developer are simultaneously driven in conjunction with the developing roller 68, only the number of revolution of the developing roller 68 is counted here, however, the number of revolution of either the magnet roller 86, the magnet roller 88 or the developer agitating section 76 may be counted so as to recognize the life of the developer.

When printing information is provided at the point in time of displaying the end of life of the developer, the printing operation is continued.

When the operator continues printing without replacing the developer, the life of the developer is over, and normal printing operation can not be conducted, so that the apparatus is stopped (step 53). Operation of the apparatus is stopped when the developing roller 68 is rotated by a predetermined number of revolution after the number of the developing roller 68 has reached a value corresponding to the near life. Alternatively, when two counted values corresponding to the near life and the apparatus stoppage are previously established, and also when the number of revolution of the developing roller 68 reaches the respective values, the apparatus may be stopped.

A message 813 meaning that "Do you want to stop the apparatus and replace the developer?" is displayed on the display section 811 (step 54).

When the operator of the multicolor electrostatic recording apparatus presses an indication button 812 on the operation panel 810 which indicates the replacement of the developer, first, it is checked whether or not the developer is provided in the developer box 649 (step 55). When the existence of the developer in the developer box 649 is checked, an optical sensor (not shown) arranged in the developer box 649 is used for the detection. In the apparatus in which the capacity of the developer box 649 is substantially the same as the capacity of the developing unit, it is checked whether or not the developer exists in the developer box 649. In the apparatus in which the capacity of the developer box 649 is given by integral multiples of the capacity of the developing unit 54, it is checked by the optical sensor whether or not a quantity of developer accommodated in the developer box 649 is larger than the capacity of the developing unit 54.

When a quantity of developer accommodated in the developer box 649 is smaller than the capacity of the developing unit 54, a message notifying the operator of the necessity of feeding the developer is displayed on the display section 811 of the operation panel 810 (step 56). After that, the apparatus is put in a waiting condition until a necessary quantity of developer is fed.

After the operator has charged developer from a developer charging port 648 into the developer box 649, the indication button 812 defining "confirmation" is pressed. When this pressing operation of the indication button 812 is detected (step 57), a quantity of developer in the developer box 649 is checked again (step 58).

When it is detected by the detection conducted on the developer in the developer box 649 that a quantity of developer is insufficient to the developing unit 54, a message to demand the operator to charge the developer in step 56 is displayed again on the display section 811.

When it is detected in step 55 or 58 that a quantity of developer in the developing box 649 is sufficient to the developing unit 54, the developer is discharged from the developing unit 54. This discharging motion will be described later.

In this discharging operation of developer, a message to notify the operator of the discharge of developer is displayed on the display section 811 (step 59).

After all the developer has been discharged from the developing unit 54, the developer charging port shutter 653 of the developer box 649 is opened by the shutter motor 651, so that the developer in the developer box 649 is charged into the developing unit 54 (step 510). During this operation, a message to notify the operator that the developer is being charged is displayed on the display section 811.

When the developer charging port shutter 653 is opened, the developer is dropped from the developer box 649 into the developing unit 54. Then the developer is conveyed into the developing unit by the conveyance screw 78.

After the developer has been conveyed into the developing unit 54, the developer agitating section 76 in which the developer is agitated is driven so as to electrically charge the developer. In this way, the developer is ready to be fed to the developing drum 48 by the developing roller 68.

After the completion of feeding the developer to the developing unit 54, the developer charging port shutter 653 is closed by the shutter motor 651. The position of the developer charging port shutter 653 is detected by the shutter sensor 652. Then a developer concentration slicing voltage in the developing unit 54 is set (step 513). When this setting is conducted, since the concentration of toner in the developing unit 54 is detected by the optical sensor, a detecting portion of the optical sensor is stained with toner, so that a quantity of emitted light or a quantity of received light is reduced. Since the toner concentration of the developer, at the point of time when the developer has been just charged into the developing unit 54, is appropriately adjusted when the developer is put on the market, an appropriate value of the toner concentration can be obtained by detecting the toner concentration of the developer at the point of time when the developer has been just charged. When this value is too low, a quantity of light on the light emitting side of the optical sensor is increased, or alternatively a signal on the light receiving side is more amplified so that the toner concentration at a normal operation can be detected. In this way, the toner concentration in the developing unit 54 can be more appropriately detected and adjusted.

After the developer in the developer box 649 has been fed into the developing unit 54, a space is formed in the developer box 649. Therefore, a larger quantity of developer can be accommodated in this space in the developer box 649. Accordingly, a message to notify the operator of the necessity of feeding the developer into the developer box 649 is displayed on the message display section 811 (step 514).

According to this message, the operator feeds the developer into the developer box 649, and the key definition of the operation panel 810 detects that the indication button 812 to indicate the completion of feeding the developer has been pressed (step 515).

The quantity of developer in the developer box 649 is checked, and it is detected that the quantity of developer in the developer box 649 is sufficient to feed the developer into the developing unit 54 (step 516). Then the apparatus is put into a waiting condition to wait for printing operation (step 516).

When the operator manually feeds the developer into the developing unit and the developer box, the developer is accommodated in the developing unit and the developer box for the replacement of developer. That is, there is provided a quantity of developer which corresponds to the use of two times. Therefore, when the life of this developer, the quantity of which corresponds to the use of two times, is nearly over, it is necessary for the operator to manually replace the developer. In order to extend an interval of replacing the developer, a quantity of developer accommodated in the developer box may be increased by integral multiples of the capacity of the developing unit.

Automatic Replacement of Developer

When the life of the developer in the developing unit 54 is nearly over, it is necessary to discharge the developer from the developing unit 54 and replace it with the developer accommodated in the developer box 649.

When toner of the developer in the developing unit 54 is fed onto the developing drum 48 by the developing roller 68, an image on the developing drum 48 is developed, and the developed image is transferred onto a sheet of transfer paper. Therefore, the quantity of toner in the developing unit 54 is reduced. The concentration of toner in the developing unit 54 is detected by an optical sensor (not shown) used for the detection of toner concentration which is arranged in the developing unit 54. When the toner concentration of the developer accommodated in the developing unit 54 is decreased to a value lower than a predetermined one, toner is fed from the toner box 642.

In order to feed the toner from the toner box 642 to the developing unit 54, a toner feed motor 647 is driven, so that a toner conveyance screw 650 is rotated. Due to the foregoing operation, toner is moved to the right in FIG. 4. Toner conveyed by the toner conveyance screw 650 is dropped from the toner feed port 656 onto the conveyance screw 78 via the toner feed roller 655. The dropped toner is conveyed into the developing unit 54 by this conveyance screw 78. The toner feed roller 655 is rotated in conjunction with the toner conveyance screw 650. When the toner feed roller 655 is stopped, it closes the toner feed port 656, so that the toner in the toner box 642 can be prevented from leaking out. When the toner feed roller 655 is rotated, the toner located in an upper portion of the toner feed roller 655 is conveyed to a lower portion, so that the toner in the toner box 642 can be fed from the toner feed port 656. A quantity of toner which has been fed is detected by the toner concentration sensor 658. When the toner concentration sensor 658 detects that a predetermined quantity of toner has been fed, the toner feed motor 647 is stopped so as to stop the toner feed operation.

There is provided an agitator for preventing the toner in the toner box 642 from being solidified by moisture. This agitator is rotated by a motor not shown via the agitator gear 645, so that the toner in the toner box 642 can be agitated. There is provided a toner empty sensor 646 for detecting a quantity of remaining toner in the toner box 642. When the toner is fed to the developing unit 54, the quantity of remaining toner in the toner box 642 is reduced. The toner empty sensor 646 detects whether or not the quantity of remaining toner has reached a predetermined value. When the toner empty sensor 646. detects that the quantity of remaining toner in the toner box 645 has reached the predetermined value, a signal to show the result of detection is outputted. By this signal, the toner feed operation is stopped, and the operator is notified that the quantity of remaining toner in the toner box 645 has reached the predetermined value.

A quantity of toner accommodated in the toner box 642 is determined in such a manner that the quantity of toner is sufficiently large for the life of the developer in the developing unit 54 and also for the life of the developer which has been fed from the developer box 649 into the developing unit 54. When the quantity of toner accommodated in the toner box 642 is determined in the manner described above, the toner may be replaced together with the developer. Therefore, it is possible to save time and labor when the developer is replaced. However, when the quantity of toner is too large, it is solidified by moisture, or high stress is given to the toner and the electrical charging property is deteriorated.

When toner is fed to the developing drum 48 by the developing roller 68 so as to conduct printing, a quantity of toner in the developing unit 54 is reduced, so that the concentration of toner in the developing unit 54 is lowered. In this case, the printing operation is continued while toner is being fed from the toner box 642 to the developing unit 54. Since the developer in the developing unit 54 is agitated at all times in the process of printing, the developer is deteriorated and it becomes impossible for the developer to be electrically charged.

Accordingly, the life of the developer is found by counting the number of revolutions of the developing roller 68 as described above.

When it is detected that the number of revolution of the developing roller 68 has reached a predetermined value (step 71), a discharging operation, which will be described later, to discharge the developer is conducted so that the developer in the developing unit 54 is discharged, and the developer is fed from the developer box 649 to the developing unit 54.

In the case where the multicolor electrostatic recording apparatus is conducting a printing operation in accordance with one printing request (step 72), the printing operation is stopped (step 72).

A quantity of developer in the developer box 649 is checked (step 74).

Figure 5:
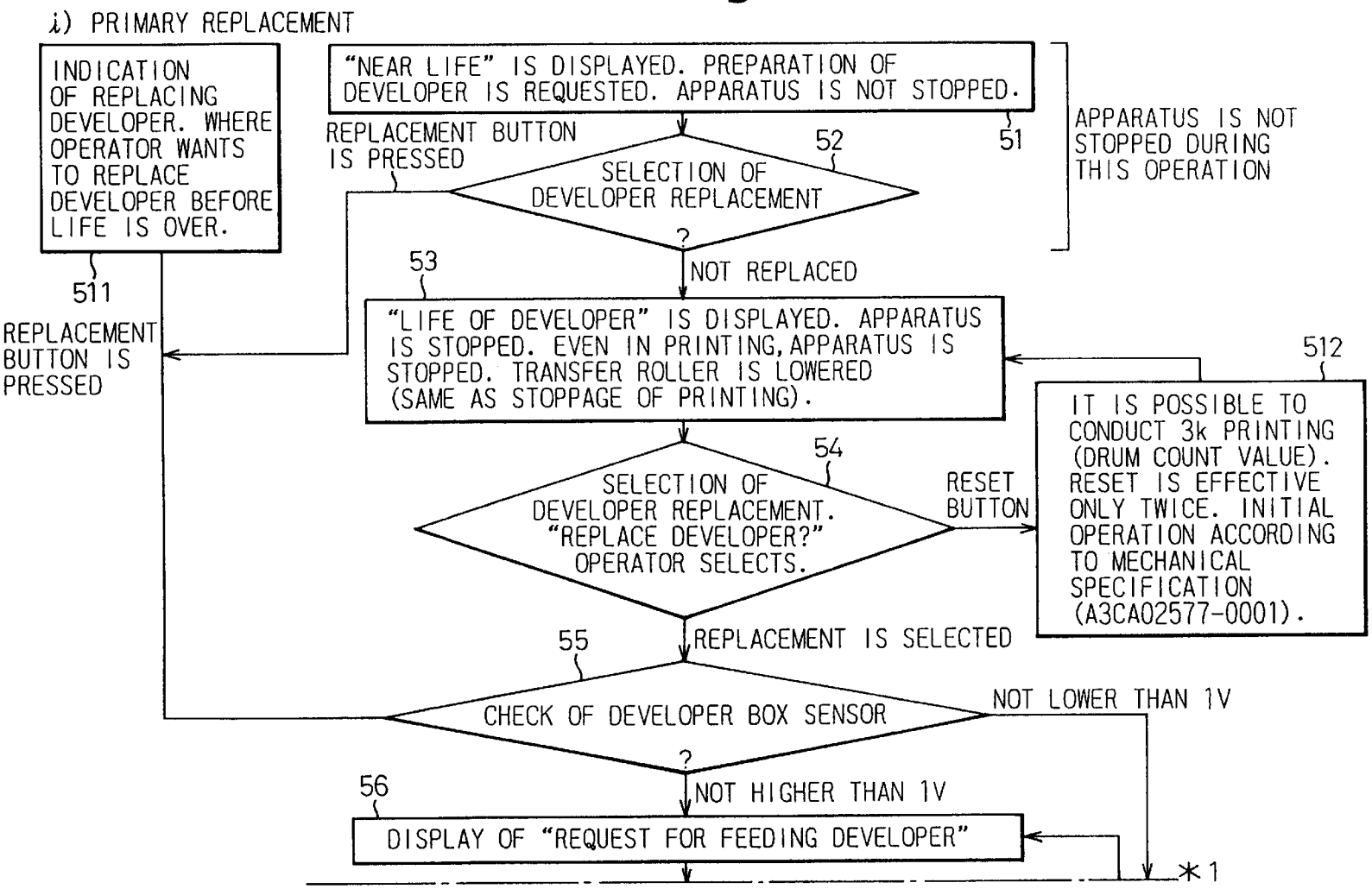
FIG. 5 is a flow chart showing a sequence of replacing the developer.
Figure 6:
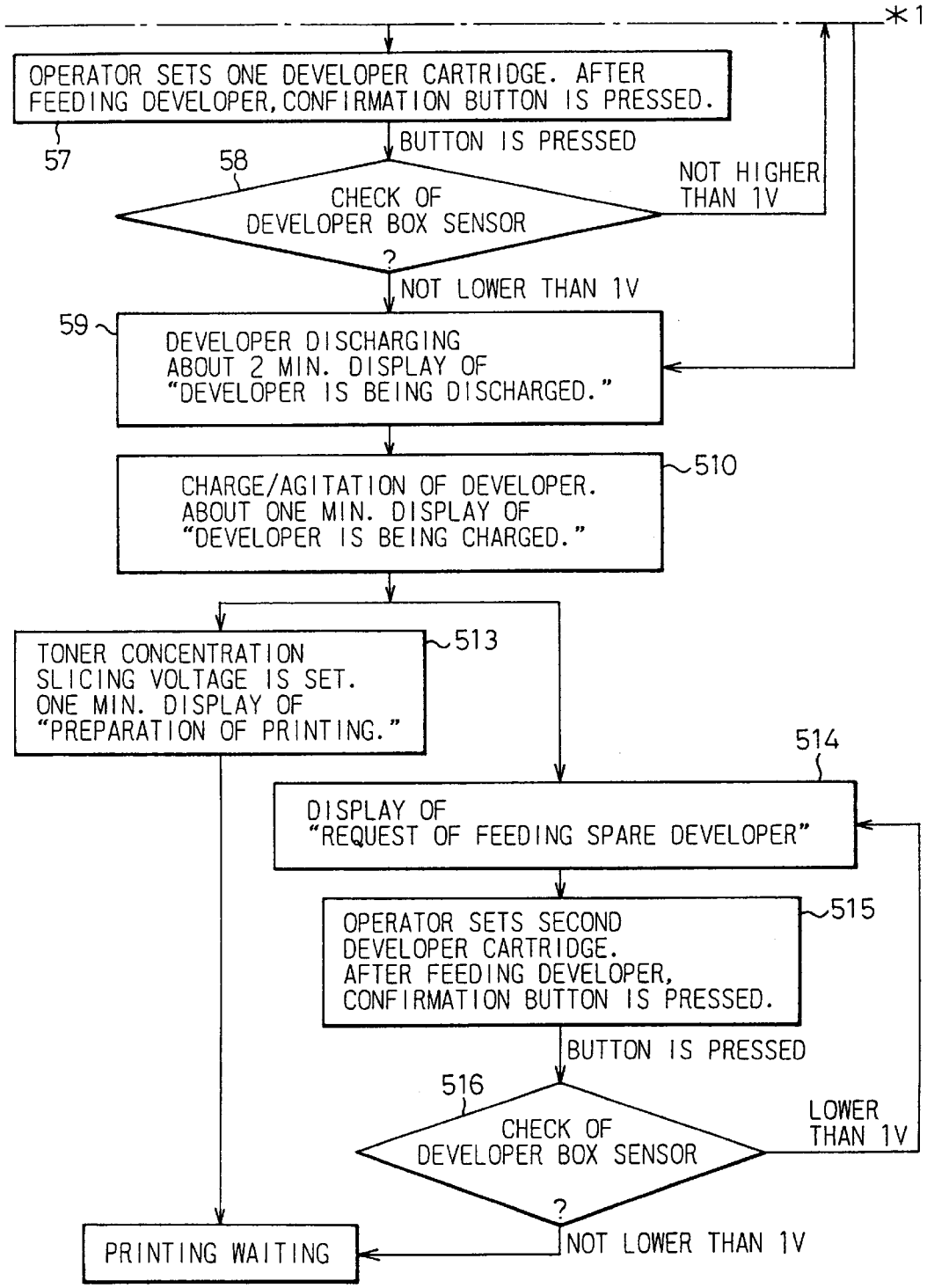
FIG. 6 is a flow chart showing a sequence of replacing the developer.
Figure 7:
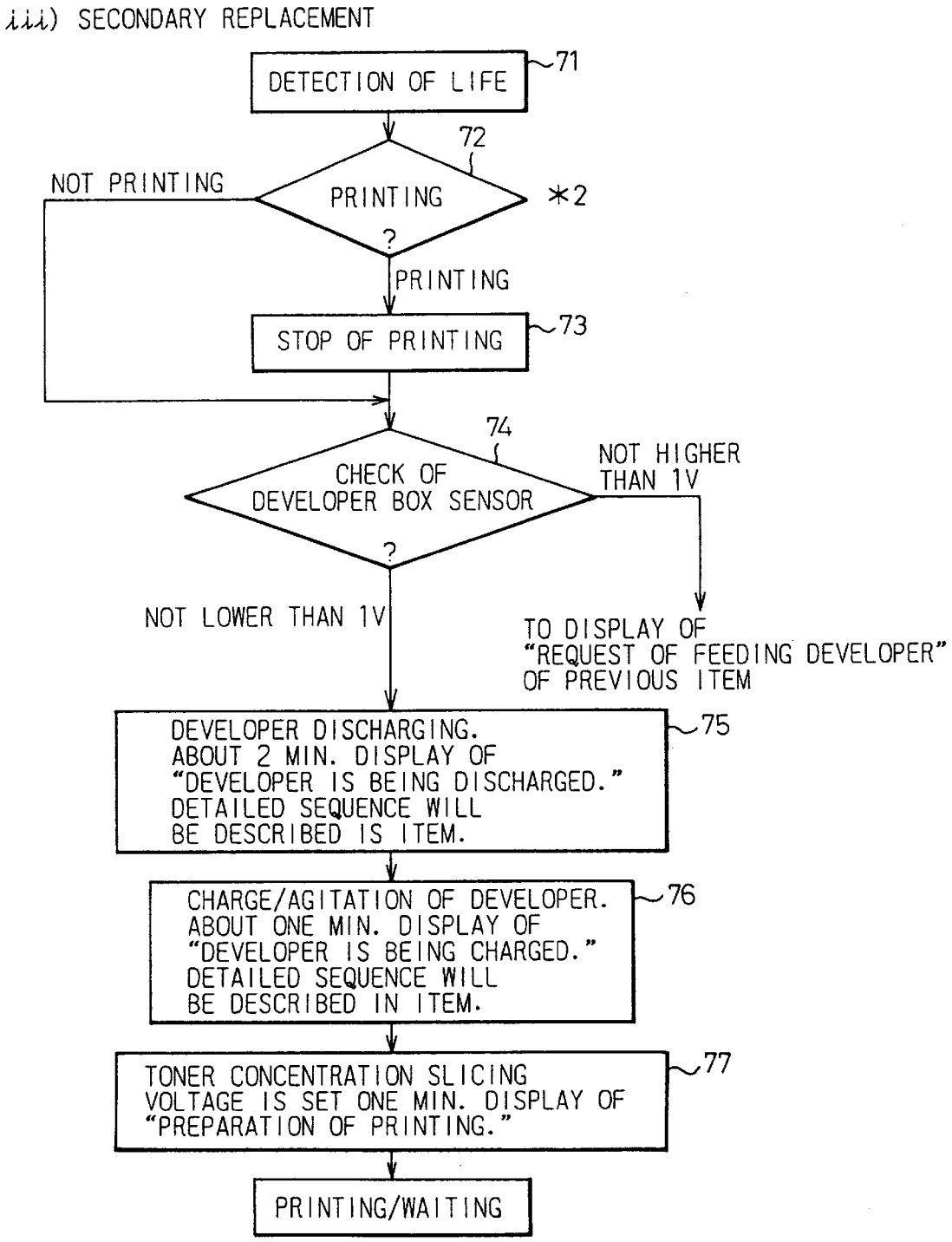
FIG. 7 is a flow chart showing a sequence of automatically replacing the developer.

When a quantity of developer in the developer box 649 is smaller than a predetermined value, that is, when a quantity of developer in the developer box 649 is smaller than a value by which a sufficient quantity of developer can be fed to the developing unit 54, it is requested to feed the developer in accordance with steps 56 to 58 shown in FIG. 5.

When a quantity of developer in the developer box 649 is larger than the predetermined value, the used developer in the developing unit 54 is discharged. Since the printing operation can not be conducted during the discharge of the used developer, a message to notify the operator of the stoppage of printing is displayed on the display section 811 (step 75).

At the point of time when all developer has been discharged from the developing unit 54, the shutter motor 651 of the developer box 649 is driven and the charging port shutter 652 is opened, so that the developer is fed from the developer box 649 to the developing unit 54, and at the same time, a message is displayed on the display section 811 which notifies the operator of the feed of developer, and the printing operation is stopped (step 76). After the developer has been charged into the developing unit 54, it is conveyed to the developing unit 54 by the conveyance screw 78. In this way, the developer is conveyed to the developing roller 68 and agitated in the developing unit 54, so that the developer can be electrically charged.

In order to detect the concentration of toner in the developer charged into the developing unit 54, a toner concentration slicing voltage is set (step 77).

After the developer in the developing unit 54 has been replaced, the printing operation is resumed.

Arrangement to Discharge the Developer

Figure 9:
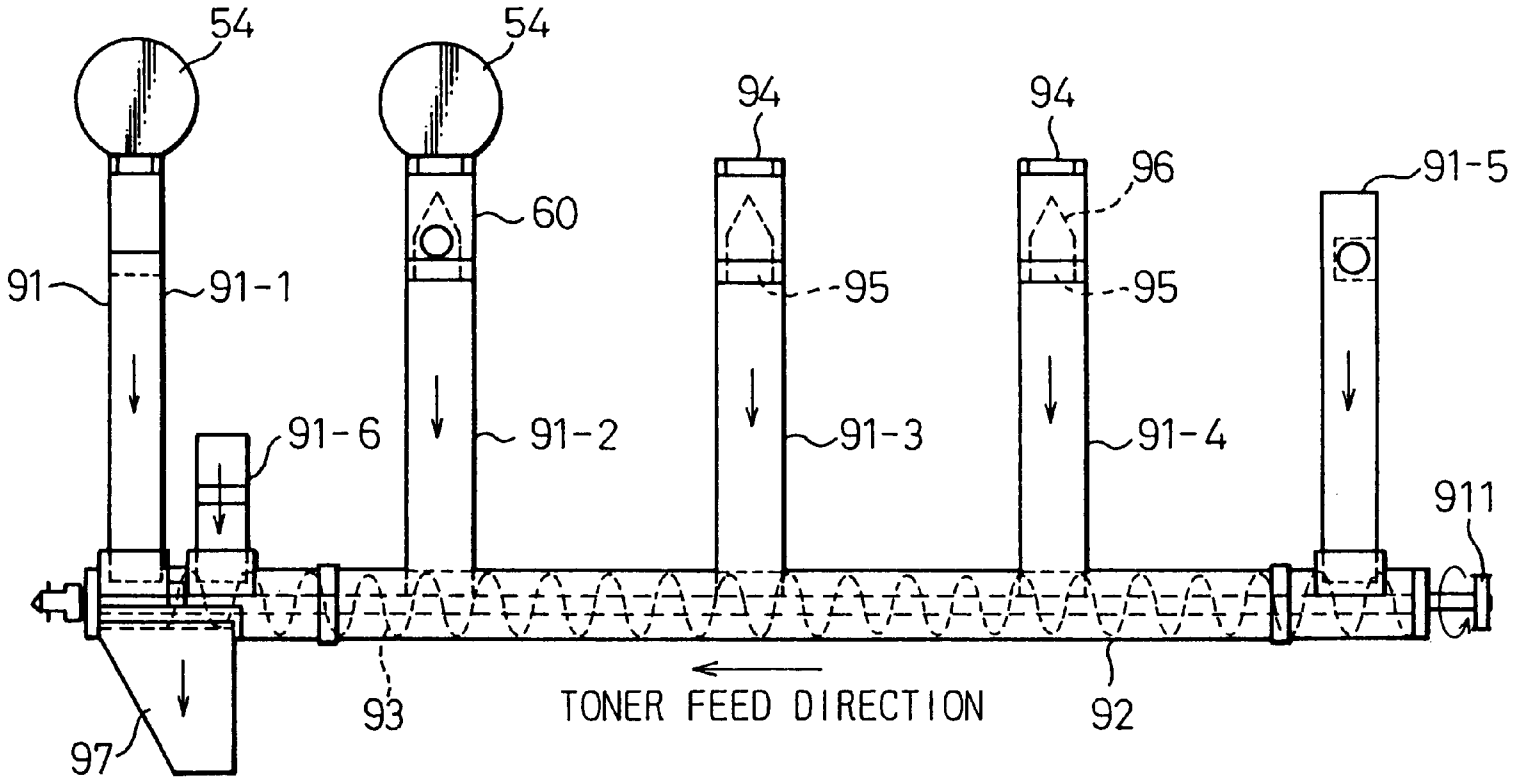
FIG. 9 is a view showing an arrangement of recovering the waste developer.
Figure 10:
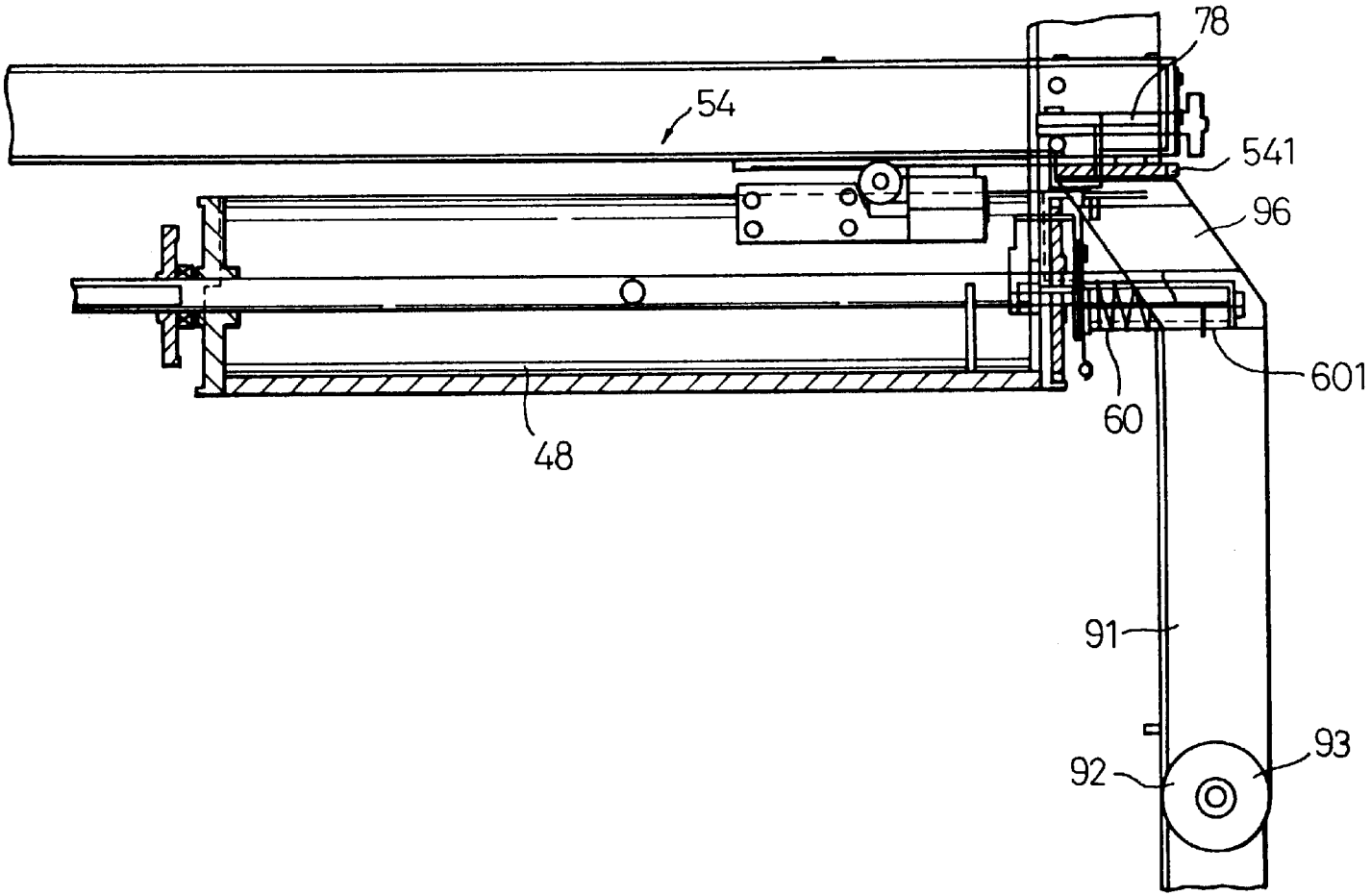
FIG. 10 is a view showing an arrangement of recovering the waste developer.
Figure 11:
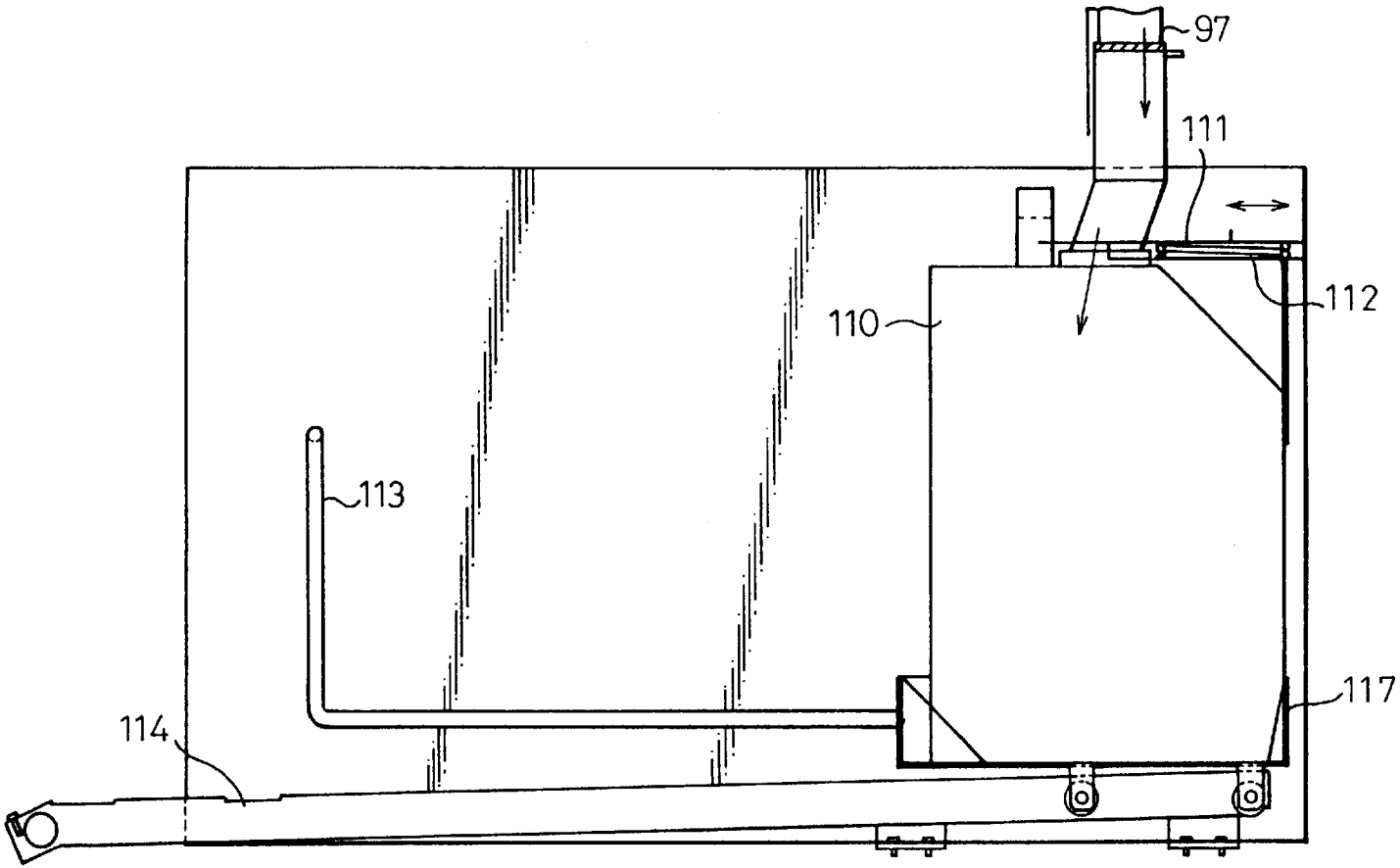
FIG. 11 is a side view showing a recovery bottle.

An arrangement to recover the waste developer discharged from a plurality of developing units 54 and also to recover the waste toner discharged from the developing drum 48 by the cleaner 60 is shown in FIGS. 9 to 11.

This arrangement includes: a plurality of vertical pipes 91, a horizontal pipe 92 to connect the plurality of vertical pipes 91, a developer conveyance screw 93 to convey the developer in the horizontal pipe 92, a rocker pipe 97 to guide the waste developer in the horizontal pipe 92 downward, and a recovery bottle 110.

The number of the vertical pipes 91 is six. The vertical pipe 91-1 is connected to a discharge port of the developing unit 54 of the electrostatic recording unit Y, and the waste developer discharged from the developing unit 54 is recovered.

The vertical pipe 91-2 is connected to a discharge port of the developing unit 54 of the electrostatic recording unit C and also connected to the cleaner 60 of the electrostatic recording unit Y. Therefore, the waste developer discharged from the developing unit 54 of the electrostatic recording unit C and the waste toner discharged from the cleaner 60 of the electrostatic recording unit Y are recovered. The vertical pipes 91-3, 91-4 are respectively connected to the discharge port of the developing unit 54 of the electrostatic recording unit M and also connected to the cleaner 60 of the electrostatic recording unit C. Therefore, the waste developer discharged from the developing unit 54 of the electrostatic recording unit M and the waste toner discharged from the cleaner 60 of the electrostatic recording unit C are recovered. The vertical pipes 91-3, 91-4 are connected to the discharge port of the developing unit 54 of the electrostatic recording unit B and also connected to the cleaner 60 of the electrostatic recording unit M. Therefore, the waste developer discharged from the developing unit 54 of the electrostatic recording unit B and the waste toner discharged from the cleaner 60 of the electrostatic recording unit M are recovered.

The vertical pipe 91-5 is connected to a discharge port of the cleaner 60 of the electrostatic recording unit B, and the waste toner discharged from the cleaner 60 is recovered.

There is provided a vertical pipe 91-6, which recovers the waste toner produced as a result of cleaning an endless belt 46*a* of an endless belt conveyance means 46 with a cleaning member such as a scraper member.

Each of the vertical pipes 91-2, 91-3, 91-4 includes: a waste developer discharge opening portion 94 to be connected with the developing unit 54; and a waste toner discharge opening portion 95 to be connected with the cleaner 60. This waste toner discharge opening portion 95 is engaged with a waste toner discharge port 601 of the cleaner 60. A waste developer cover is attached at an upper portion of the waste toner discharge opening portion 95. By this waste developer cover, the developer discharged from the developing unit 46 is not dropped and accumulated on an upper portion of the waste toner discharge port 95 engaged with the vertical pipe 91.

The developer which has passed through a plurality of vertical pipes 91 drops into a horizontal pipe 92 with which each vertical pipe 91 is connected. There is provided only one horizontal pipe 91 in this multicolor electrostatic recording apparatus. This horizontal pipe 91 recovers the dropped developer into a recovery bottle 110 via the rocker pipe when a waste developer conveyance screw 93 is rotated. This waste developer conveyance screw 93 is driven by a motor not shown via a gear 911.

The vertical pipes 91 to recover the waste developer and the horizontal pipe 92 are arranged on the back of the multicolor electrostatic recording apparatus. In this case, the door side of the apparatus capable of being opened and closed for the replacement of the developing drum and the clearance of jammed sheets is defined as a front side.

The recovery bottle 110 is also arranged on the back of the apparatus so that the waste developer conveyed in the horizontal pipe 92 can be dropped into the recovery bottle 110. Due to the above arrangement, it is possible to recover the waste developer without providing a conveyance mechanism to convey the waste developer such as a screw, motor and gear. In this arrangement, only one recovery bottle is arranged. Therefore, the space can be effectively used for the installation of the recovery bottle. Moreover, in the case of replacing the recovery bottle, it is easy to replace only one recovery bottle.

Figure 12:
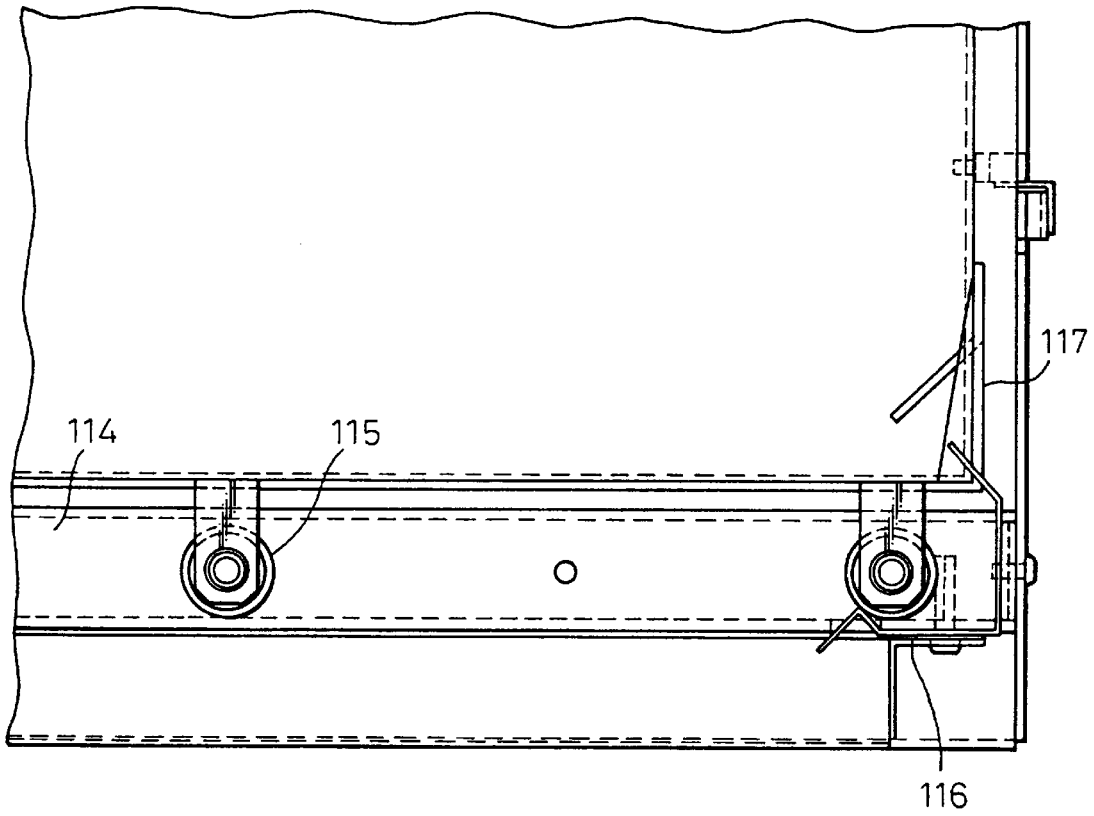
FIG. 12 is a view showing an arrangement for positioning a recovery bottle at a recovery position.

This recovery bottle 110 is capable of moving between the waste developer recovery position and the recovery bottle removal position, that is, this recovery bottle 110 is capable of moving between the front and the inner portion of the apparatus. After the recovery bottle 110 has been moved to the waste developer recovery position, it is fixed so that it cannot be moved. An example of this arrangement is shown in FIG. 12. At a bottom of the holding portion 117 in which the recovery bottle 110 is set, there is provided a wheel 115, which is rotatably arranged and capable of moving along a rail 114. In order to position the recovery bottle 110 at the waste developer recovery position, there is provided a lock spring 116 on the rail 114. A portion of this lock spring 116 is protruded from a surface of the rail 114 with which the wheel 115 comes into contact. This protruding portion of the lock spring 116 locks the wheel 115 when the recovery bottle 110 comes to the waste developer recovery position, so that the wheel 115 can not move along the rail 114. Due to the above arrangement, the recovery bottle 110 can be positioned at the recovery position with a simple structure. The rail 114 is inclined to the front of the apparatus. Accordingly, even when the recovery bottle 110 is filled with the waste developer, it can be easily moved to the front of the apparatus when it is pulled by a force of low intensity.

When the recovery bottle 110 is filled up with the waste developer and it is necessary to replace it, an operator releases the lock of the recovery bottle 110 and holds a handle 113 and pulls it out along the rail. After the recovery bottle 110 has been replaced with an empty bottle, it is pushed into the recovery position along the rail while the operator holds the handle 113. Then the recovery bottle 110 is fixed at the recovery position. There is provided a shutter 111 for closing the rocker pipe 97 when the recovery bottle 110 is pulled out from and pushed into the recovery position. The shutter 111 is always pushed by a spring 112 in a direction of pulling out the recovery bottle so that the rocker pipe 97 can be closed when the recovery bottle 110 is pulled out. Since the shutter 111 closes the rocker pipe 97 in accordance with the motion of pulling out the recovery bottle 110, no waste developer overflows into the apparatus from the rocker pipe 97 even when the waste developer is conveyed in the process of replacement of the recovery bottle 110. When the empty recovery bottle 110 is set at the recovery position, the rocker pipe 97 is opened, so that the waste developer can be recovered a into the recovery bottle 110.

Developer Discharge Motion

When it becomes necessary to discharge the developer from the developing unit 54, the shutter motor 542 is driven so that the discharge port shutter 541 is moved and the discharge port 540 is opened. When the conveyance screw 78*a* in the developing unit 54 is driven, the developer in the developing unit 54 is moved to the discharge port side 540. Then the moved developer is dropped into the horizontal pipe 92 via the vertical pipe 91. When the waste developer conveyance screw 93 is rotated, the developer in the horizontal pipe 92 is conveyed toward the rocker pipe 97. After the waste developer has been collected into the rocker pipe 97, it is recovered to the recovery bottle 110.

When it is detected that all developer has been discharged from the developing unit 54, the shutter motor 542 is driven and the discharge port shutter 541 is moved, so that the discharge port 540 is closed.

Next, the shutter motor 651 of the developer box 649 is driven, and the charge port shutter 653 is moved. In this way, the developer charge port 654 is opened, and a quantity of developer which is substantially the same as the capacity of the developing unit 54 is fed to the developing unit 54. When the shutter motor 651 is driven, the discharge port 540 is closed by the discharge port shutter 541. The developer fed from the developer box 649 into the developing unit 54 is conveyed into the developing unit 54 by the conveyance screw 78*a* arranged in the developing unit.

Arrangement of Developer Feed Unit

Figure 13:
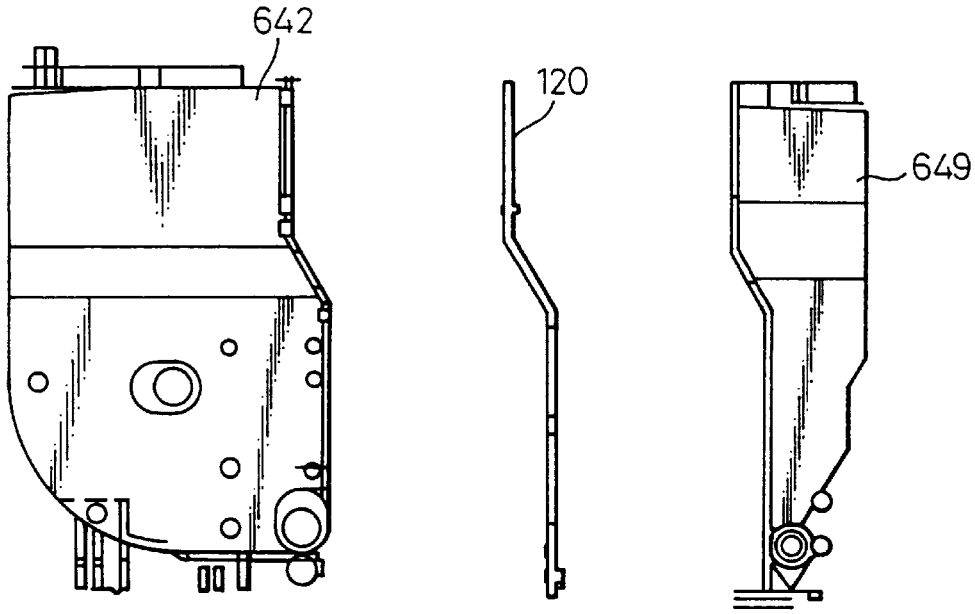
FIG. 13 is a view showing the structure of a developer feed unit.
Figure 14A:
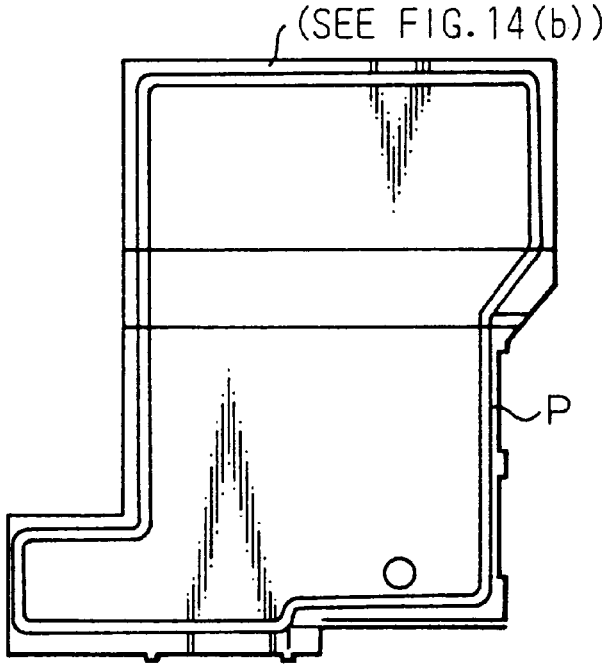
FIG. 14(*a*) is a view showing a partition plate.
Figure 14B:
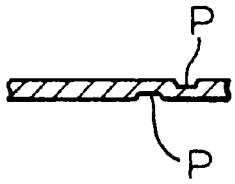

The developer feed unit 64 is composed as shown in FIGS. 13 and 14(*a*), 14(*b*).

The developer feed unit 64 includes: a toner box 642, a partition plate 120, and a developer box 649. The toner box 642, partition plate 120 and developer box 649 are assembled into the developer feed unit 64 by several screws.

As shown in FIG. 14(*b*), which is a view showing the detail of the partition plate 120, the partition plate 120 has an injection groove P for injecting gelled silicone into a joint portion of the toner box 642 and the developer box 649. When gelled silicone is injected into this injection groove, the toner box 642 and the developer box 649 can be maintained in an airtight condition.

Due to the above arrangement, a period of replacing the developer can be prolonged.

When a developer accommodating capacity of the developer feed device in a plurality of developing units of a multicolor electrostatic recording apparatus, which is more frequently used than other developing units, is larger than the developer accommodating capacity of the developer feed devices of other developing units, the developer in a plurality of developing units can be replaced in unison. Therefore, it is possible to save time and labor when the developer is replaced.

Since the developer discharged from the developing unit can be recovered into the recovery box, it is possible to automatically replace the developer.

Even when the developer is recovered from a plurality of developing units and a plurality of cleaners, the number of vertical pipes necessary for the recovery of developer may be a value obtained when one is added to the number of the developing units. Moreover, the number of the horizontal pipes to connect the vertical pipes may be only one. Accordingly, the structure for recovering the developer is simple.

What is claimed is:

1. A two-component developing apparatus for developing an electrostatic latent image formed on a latent image carrying body with a two-component developer, said developing apparatus comprising:

a developing unit including means for supplying the developer to said latent image carrying body to develop said latent image on said latent image carrying body and means for accommodating the developer;

a developer storage means for storing a fresh developer which is to be supplied to said developing unit; and a toner storage means for storing a toner which is to be supplied to said developing unit; and means for supplying the toner in the toner storage means to said developing unit in accordance with a first instruction that a supplement to the toner is required;

developer changing means for replacing the developer accommodated in said developing unit by the fresh developer stored in said developer storage means in accordance with second instructions that a replacement of developer is now required.

2. An image forming apparatus comprising:

a plurality of latent image carrying bodies for carrying latent images;

a plurality of developing of developing units each including means for supplying a developer to said respective latent image carrying body to develop said latent image on said latent image carrying body and means for accommodating the developer;

at least one developer storage means for storing a fresh developer which is to be supplied to at least one of said developing units; and developer changing means for replacing the developer accommodated in said developing unit by the fresh developer stored in said developer storage means in accordance with an instruction that a replacement of developer is required, wherein said plurality of developing units develop with a plurality of different color developers including a black developer, said developer storage means stores a black developer which is to be supplied to a black developing unit which develops with the black developer, said developer storage means has a volume which is an integer multiple of the volume of the black developer which can be accommodated in said black developing unit.

* * * * *